US007289638B2

(12) United States Patent
Pavlovic et al.

(10) Patent No.: US 7,289,638 B2
(45) Date of Patent: Oct. 30, 2007

(54) ELECTROACOUSTIC MICROPHONE

(75) Inventors: Gino Pavlovic, Vienna (AT); Kurt Nell, Breitenfurt (AT)

(73) Assignee: AKG Acoustics GmbH, Vienna (AT)

( * ) Notice: Subject to any disclaimer, the term of this patent is extended or adjusted under 35 U.S.C. 154(b) by 623 days.

(21) Appl. No.: 10/071,074

(22) Filed: Feb. 8, 2002

(65) Prior Publication Data

US 2002/0114476 A1 Aug. 22, 2002

(30) Foreign Application Priority Data

Feb. 20, 2001 (AT) ..... A 265/2001

(51) Int. Cl.
*H04R 3/00* (2006.01)
*H04R 25/00* (2006.01)

(52) U.S. Cl. ..... 381/174; 381/113; 381/190; 381/191

(58) Field of Classification Search ..... 381/173, 381/174, 176, 113–114, 116, 190–191, 369, 381/429, 423, 152
See application file for complete search history.

(56) References Cited

U.S. PATENT DOCUMENTS 3,418,435 A * 12/1968 Elwood ..... 369/86
3,599,988 A * 8/1971 Elwood ..... 369/40.01
3,812,575 A * 5/1974 Hedman ..... 29/594
3,894,198 A * 7/1975 Murayama et al. ..... 381/114
4,117,275 A * 9/1978 Miyanaga et al. ..... 381/174
4,148,492 A * 4/1979 Bachelet ..... 369/226
4,302,633 A * 11/1981 Tamamura et al. ..... 307/400
4,360,955 A * 11/1982 Block ..... 29/25.42
4,392,025 A * 7/1983 Tamamura et al. ..... 381/174
5,146,435 A * 9/1992 Bernstein ..... 367/181
6,594,369 B1 * 7/2003 Une ..... 381/174
6,731,766 B2 * 5/2004 Yasuno et al. ..... 381/171
6,738,484 B2 * 5/2004 Nakabayashi ..... 381/174
6,792,123 B2 * 9/2004 Pavlovic ..... 381/174
2003/0165251 A1 * 9/2003 Pribyl ..... 381/369
2003/0165252 A1 * 9/2003 Pribyl ..... 381/369
2004/0040382 A1 * 3/2004 Peterson et al. ..... 73/708

* cited by examiner

*Primary Examiner*—Curtis Kuntz
*Assistant Examiner*—P L Dabney
(74) *Attorney, Agent, or Firm*—Friedrich Kueffner

(57) ABSTRACT

An electroacoustic capsule or electroacoustic transducer for an electroacoustic device has electrostrictive or magnetostrictive elements connected to a controllable power supply. Dimensional changes of the electrostrictive or magnetostrictive elements cause changes of the inner geometry of the electroacoustic capsule or electroacoustic transducer. This allows the adjustment of the capsule or transducer to the electroacoustic device in which it is mounted so that individual and dynamic adjustments are possible.

11 Claims, 3 Drawing Sheets

ELECTROACOUSTIC MICROPHONE

BACKGROUND OF THE INVENTION

1. Field of the Invention

The invention relates to an electroacoustic capsule or transducer for an electroacoustic device. The transducer can operate either according to the electromagnetic, electrodynamic, electrostatic, or piezoelectric principle and can be embodied either as a sound emitter or a sound receiver.

2. Description of the Related Art

Such devices are comprised substantially of the actual electroacoustic transducer which is inserted into a so-called capsule which, in turn, is mounted in a device housing in which all required electronic components are also arranged.

Electroacoustic devices comprise at least one so-called electroacoustic capsule which is, in turn, either embodied as a sound source or a sound receiver. For the purpose of simplifying the language in the present description and claims, electroacoustic devices which comprise at least one capsule functioning as a sound receiver are referred to as microphones. Headsets are mentioned as being representative of electroacoustic devices with at least one electroacoustic capsule which is embodied as a sound source.

The two device groups however have one commonality: the acoustic properties of the devices are predetermined by the manufacturer during the course of the production process and are therefore unchangeable by the consumer. Expressed more simply, the device has an unchangeable sound characteristic.

For example, the acoustic properties of a microphone with an electrostatic capsule depend essentially on the spacing between the diaphragm and the electrode and on the design of the acoustic tuning elements of the capsule. When the geometric parameters between the movable electrode (the diaphragm), which is exposed to the sound field, and the stationary electrode are fixed and when also the acoustic tuning elements in the interior of the capsule (narrow channels, closed volumes, and only partially air-permeable areas) are calculated and mechanically realize, then the directivity pattern, the output level, and the frequency response characteristic are also fixed and unchangeable.

The capsule is therefore always configured with respect to the intended use, and it is generally not possible to employ an existing capsule in another housing or device without suffering great quality losses. This is true for sound receiving as well as sound emitting capsules.

This property requires a series of capsule developments, not to mention stocking expenses and providing different tools for their manufacture, which, in particular, in view of the currently conventional fast model changes, can become expensive very quickly.

The acoustic tuning of electroacoustic capsules, independent of whether they are manufactured as a sound receiver or sound emitter, must not be determined in series of experiments at random, but can be calculated within wide ranges. This calculation is based on the matching mathematical models for acoustics and electricity and is carried out based on the electroacoustic analogy principle. It is performed by means of so-called equivalent circuits. In this connection, narrow and long channels in the acoustic system correspond to a coil in the electric system, closed volumes in the acoustic system correspond to the capacitor in the electric system, and bores covered with porous or only partially air-permeable material in the acoustic system correspond to an ohmic resistance in the electric system. Accordingly, the acoustic side can be transferred into a circuit diagram which is dimensioned and tuned according to the general rules of electrical engineering in the desired way, and the result is then transferred back into the acoustic system.

By combining all three electroacoustic elements, it is thus possible to perform the desired tuning of the respective electroacoustic transducer. It has been shown that in particular narrow channels play an important role for an expedient tone color tuning of electroacoustic transducers. This is based on the fact that a narrow channel not only has an inductive impedance proportion but also a considerable large proportion of ohmic resistance. The generation of the latter can be traced back to flow losses in narrow channels.

Based on this knowledge, a so-called "friction pill" has been produced which has ohmic as well as inductive proportions with regard to its impedance and is described in AT 400 910 B. This patent document suggests to connect two plates, made of hard material and provided with small openings on their edges, by means of a screw at the center of the plates. By a targeted rotation of the plates relative to one another it is possible to affect the impedance of this configuration in the axial direction.

Another known possibility of changing the impedance resides in that the plates are not rotated relative to one another, but the spacing between the plates is changed by means of the central screw. The impedance change of the resulting so-called friction pill has an effect mainly on the sound of the microphone or the headset. This means that simultaneously not only the frequency response characteristic but also the directivity pattern of the microphone or the headset is changed. In any case, and independent of whether the tuning elements of the capsule can be changed during production or not, the acoustic tuning is carried out presently only once, i.e., before assembly of the capsule, and remains unchanged during the entire service life of the electroacoustic device. This is a condition which is only hesitantly accepted by the users of the microphones or the headsets.

Not only the sound characteristic of the electroacoustic device is decisive for its appropriate use. Its properties relative to the transmission quality are also important. They are determined primarily by the output level of the electroacoustic transducer.

Further relationships are the following. In addition to the described effect of an acoustic impedance pill (friction pill), the spacing between the electrode and the diaphragm affects the capsule capacitance and thus the output level of the capsule. The above described capsule, as a result of its mounting in a microphone housing, is connected electrically to the input of an amplifier provided within the microphone housing. By doing so, electroacoustic transmission properties of the microphone are determined significantly by both components. This means that the lowest as well as the highest sound pressures which can be transmitted without significant decrease of the transmission quality depend on the transmission properties of the microphone capsule and the microphone amplifier.

The lowest sound intensities which can still be transmitted are limited downwardly by the so-called background noise of the microphone. This is a thermal noise which occurs in all electronic devices. The strongest sound intensities still to be transmitted are limited by the limited power supply of the microphone amplifier because it is impossible for the output voltage of an amplifier to become greater than its supply voltage.

Development engineers in the electroacoustic field are always attempting to construct electroacoustic devices such that they can transmit very low volume as well as very high volume sound events without substantial quality losses. In order to configure a microphone capsule for even smaller sound pressures, it has to be configured such that it is as responsive as possible relative to sound pressure fluctuations. This means that its transmission factor should be as large as possible. This can be achieved with electrostatic sound receivers such that the spacing between the electrodes is as small as possible. On the other hand, in the case of very high sound pressures, the electric voltage at the input of the amplifier becomes so high that the output voltage of the amplifier, even for a sound pressure that is lower than before, reaches the level of the supply voltage of the amplifier as a natural amplification limit. This means that a compromise must be accepted with respect to the minimal and maximal sound pressures still to be transmitted, the so-called dynamic response.

However, when it is known that in a recording situation only very low volume sound events, for example, piano passages of a concert, or only very high volume sound events, for example, a percussion recording, are to be expected, the described disadvantages can be partially alleviated by placing the microphones in strategic places. This means that in the case of low volume sound sources the microphone is to be placed closer to the sound source and in the reverse situation of loud instruments the microphone is to be moved father away from the sound source. However, it is apparent that this can be realized only with difficulty and only in very rare situations.

Some microphone manufacturers alleviate this dilemma by mounting a so-called attenuator. A voltage divider between the capsule and the amplifier is switched on manually as needed so that for high volume sound events the amplifier does not receive a capsule signal that is too large. The attenuation of the microphone capsule signal is performed for electrostatic microphone transducers within the high-resistivity range, and this results in a series of circuit-technological difficulties. Primarily, for high-resistivity circuits suitable switches must be used. This means that only special and thus expensive switches can be used. Since the discussed example relates to a microphone capsule operating according to the electrostatic principle, which is represented as a capacitor in the electric circuit of the microphone, it is required to use so-called capacitive voltage dividers. They are realized with the aid of electric capacitors and make possible the desired signal attenuation within a broad range. However, unfortunately the total harmonic distortion (distortion of the output signal) increases audibly when a capacitive attenuator is used for such capsules. Therefore, such microphones are avoided for high-quality applications.

SUMMARY OF THE INVENTION

It is therefore an object of the present invention to enable a change of the electroacoustic properties for transducers or capsules after their manufacture in a directed and simple way, preferably when mounting the capsule in a housing. Of course, the users of electroacoustic devices are interested in being able to adjust the acoustic properties to the respective use.

In accordance with the present invention, this is achieved in that changes in the inner geometry of the transducer or the capsule can be realized by electrostrictive or magnetostrictive elements, preferably by piezoelectric components. These components are connected to a controllable power supply and the dimensional changes of the electrostrictive or magnetostrictive elements result in changes of the inner geometry of the capsule or the transducer.

The wording "changes in the inner geometry" in the description and the claims refers to the change of the spacing between electrode and diaphragm of an electrostatic transducer as well as to the change of the spacing of components of the capsule relative to one another as, for example, in the case of one of the aforementioned friction pills but also the opening or closing or changing of the size of an opening or the like.

The term "electrostrictive or magnetostrictive elements" in the description and the claims refers to all components which upon supplying an electric voltage reversibly change a characteristic body dimension by an amount that depends on the supplied voltage. Examples are, in addition to the aforementioned piezoelectric components, which reversibly change their geometric dimensions by supplying a voltage, also magnetostrictive elements which reversibly change their geometric dimensions as a result of the effect of a magnetic field.

DESCRIPTION OF THE PREFERRED EMBODIMENTS

Figure 1:
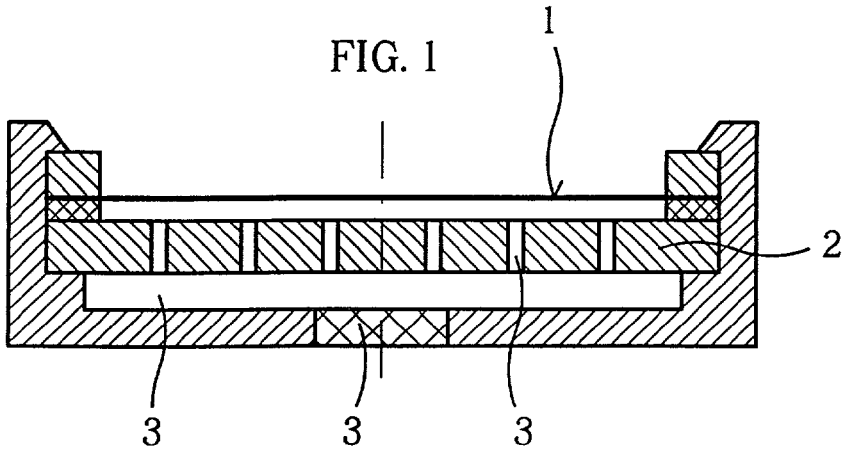
FIG. 1 is an electrostatic transducer according to the prior art.

FIG. 1 shows as an example a sound-receiving capsule operating according to the electrostatic principle for mounting in a microphone. The acoustic properties of the microphone depend essentially on the spacing between the diaphragm 1 and the electrode 2 and on the configuration of the acoustic tuning elements 3 (size of the rearward volume, friction in the rearward sound entry opening, size and number of the openings in the electrode 2) of the capsule. When the geometric parameters between the movable electrode (the diaphragm) exposed to the sound field and the stationary electrode 2 are fixed, and when also the acoustic tuning parameters 3 in the interior of the capsule (narrow channels, closed volumes, and only partially air-permeable areas) are calculated and mechanically realized, the directivity pattern, the output level, and the frequency response characteristic are also fixed and unchangeable. The boundary conditions for the illustrated capsule are determined by means of the microphone housing (not illustrated); when changing them, the corresponding tuning parameters 3 in the interior of the capsule are no longer able to ensure the desired transmission behavior.

Figure 2:
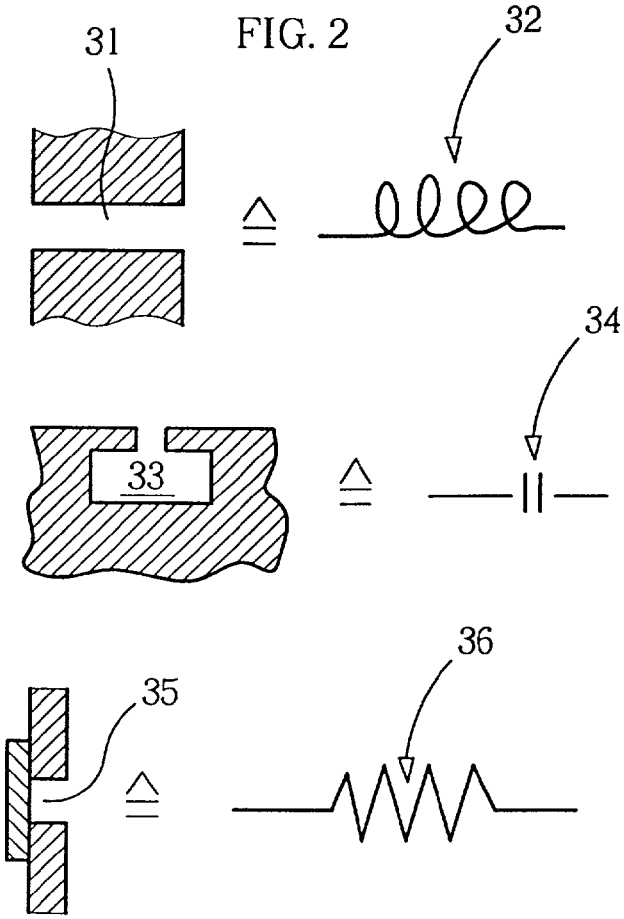
FIG. 2 illustrates the principle of electroacoustic analogy.

FIG. 2 shows the corresponding elements of the electroacoustic analogs: on the left side the acoustic elements; on the right side the corresponding electrical elements. Narrow and long channels 31 in the acoustic system correspond to a coil 32 in the electric system; closed volumes 33 in the acoustic system correspond to a capacitor 34 in the electric system; and bores 35 covered with porous or only partially air-permeable material in the acoustic system correspond to an ohmic resistance 36 in the electric system.

Figure 3:
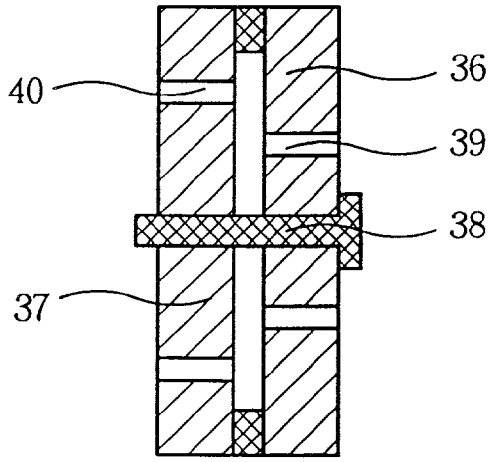
FIG. 3 shows a known friction pill in a schematic side view.

FIG. 3 shows a friction pill according to the above mentioned patent document (AT 400 910 B): two plates 36, 37 made of hard material and provided at their edges with small openings 39, 40 are connected by means of a screw 38 at their center. With a targeted rotation of the plates 36, 37 relative to one another it is possible to affect the acoustic impedance of this configuration in the axial direction because the rotation results in a change of the length of the paths.

Figure 4:
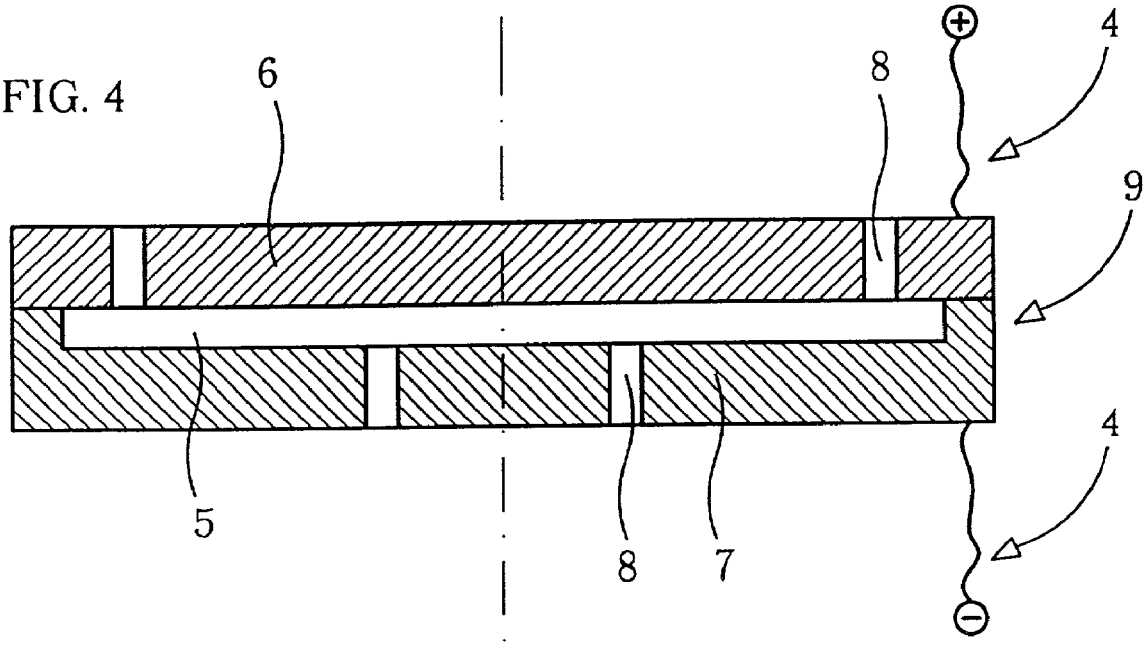
FIG. 4 shows an electroacoustic friction pill according to the invention.

FIG. 4 shows an embodiment according to the invention of the electroacoustic friction pill. It is comprised of plates 6, 7 provided at their edges with small openings 8 and comprised of piezoelectric material. The electric contacting of the plates 6 and 7 is realized by means of any suitable known type of contacts 4. The plates are metal-coated at the top and bottom sides and are connected electrically in series. By connecting them to a direct-current power source, they expand such that the height of the spacing 5 between the plates 6, 7 is reduced.

The change of the voltage connected to the plates causes as a result of the change of the spacing 5 between the plates 6, 7 a change of the acoustic impedance in the axial direction. As a result of this it is possible to affect the sound of the microphone or of the headset, into which this friction pill has been mounted, from the exterior without requiring that the microphone capsule or headset capsule or the microphone or the headset itself must be disassembled or demounted.

It is also possible to replace one of the two plates 6 or 7 with a plate made of a conventional material, for example, of plastic or metal, so that only one plate contributes in regard to the reduction of the plate spacing. The plates must not be circular; all other geometric configurations, from a rectangular to an oval configuration, are conceivable. However, they must have at least one opening 8 each at the edge or in the interior for allowing passage of air or sound. The initial spacing of the plates 6, 7 is determined in the illustrated embodiment by a small step 9 at the edge of the plate 7. It is also possible to employ a spacer ring instead of the step 9. By polarity reversal of the polarization voltage it is possible to reduce the spacing between the plates (at a radial spacing from the step 9) as well as to enlarge it.

Figure 5:
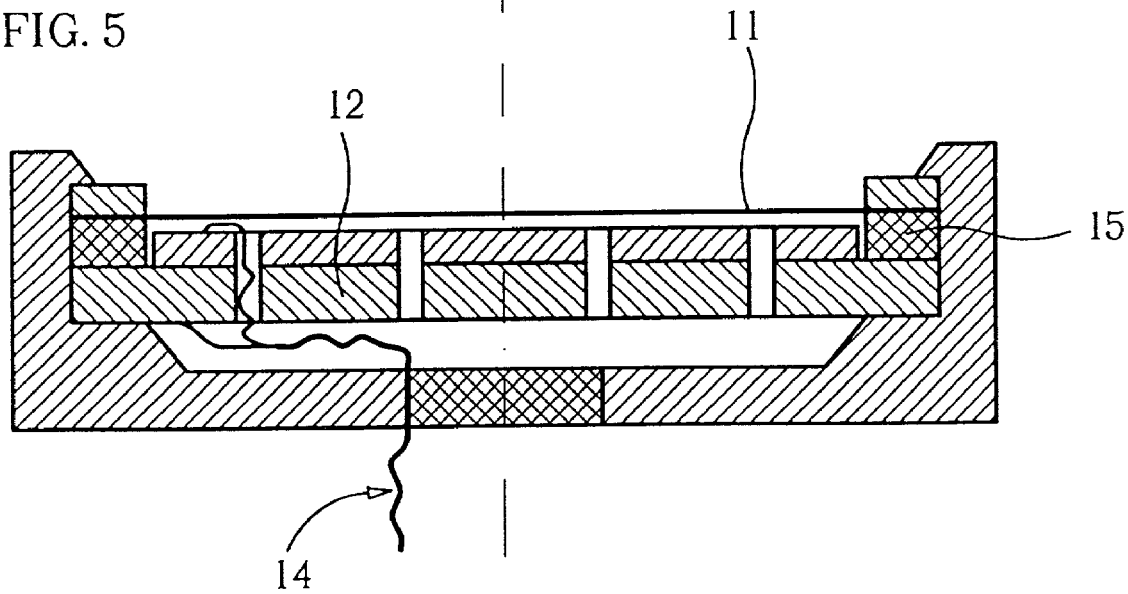
FIG. 5 shows a transducer embodied according to the invention.

FIG. 5 shows the inventive application of an electrode made of piezoelectric material which can be used for electrostatic microphone capsules. The difference to FIG. 1, showing a conventionally electrostatic microphone capsule, resides in the electrode 12. It now takes on a second function and is not only connected to the microphone amplifier via electrical contacting as one of the two capacitor electrodes of the electroacoustic transducer but is also connected by a second contact 14 to a second electrical circuit. In this way, it is possible to change the thickness of the electrode 12 by supplying a control voltage via contact 14 and to thus change also the spacing between electrode 12 and diaphragm 11. Of course, it is also possible to arrange the piezoelectric elements in the area of the securing ring 15 for the diaphragm and to change thus directly the spacing between diaphragm and electrode and not via the intermediate step of changing the thickness of the electrode 12.

Particularly advantageous in this connection is the action of affecting the output level of the microphone. It is then possible to eliminate the above described external attenuating capacitors and to change directly the spacing between diaphragm and electrode instead. In this connection, the reduction of the spacing between the electrodes 11, 12 of the transducer, realizing by supplying a control voltage to the electrode, results in an increase of the capsule output level. Since the reduction of the spacing between diaphragm and electrode also increases the capacitance of the capsule, this has the advantage that the capsule, adjusted to be more responsive, automatically also has a greater capacitance. Since the noise of a C microphone is the smaller the greater its capsule capacitance, it is possible with the invention to construct highly responsive and low-noise microphones which still have a wide dynamic response because it is possible to switch the capsule to be less responsive (large distance between the electrode and the diaphragm) for recordings of high volume sound events.

In order to provide results with improved reproducibility, the capsule capacitance in the microphone can be used as a measured value for a control loop. In this way, manufacturing tolerances and temperature effects which have a negative effect on the spacing between the electrodes can be compensated in a simple and reliable way. Providing a corresponding electronic device is no problem for a person skilled in the art of tuning microphones in view of the disclosure of the invention.

Since the piezoelectric plates in both applications, considered electrically, are high-resistivity devices, no significant amount of current flows through them which has a positive effect on the total power consumption of the electroacoustic device. The described plates are to be understood as plates of a capacitor, considered in an electrical sense, which means, in turn, that there is only a short charging current within the electric control circuit; it is present only until the capacitor has been charged to the value of the connected voltage (a few milliseconds). For the above described reason (no current flow), the voltage connected to the plates can be referred to as polarization voltage.

The magnitude of the polarization voltage can be changed either continuously or in predetermined steps. The power supply itself is a direct-current power supply and its voltage, as needed, can be up to several 100 V. Since the power supply must not provide a significant current intensity, it is also possible to eliminate all current protection measures (current limiting). The voltage can either be derived from the power supply of the device (phantom power supply in the case of capacitor microphones) or also from a control voltage connected to the device.

Figure 6:
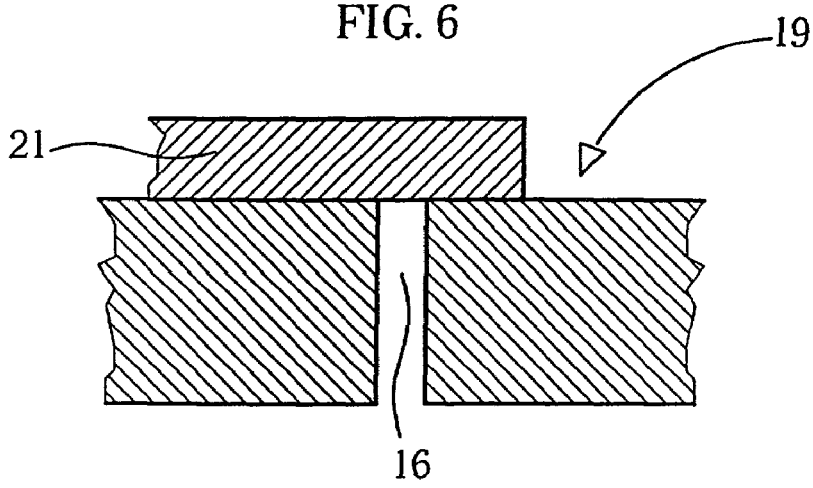
FIG. 6 is a first detail view.
Figure 7:
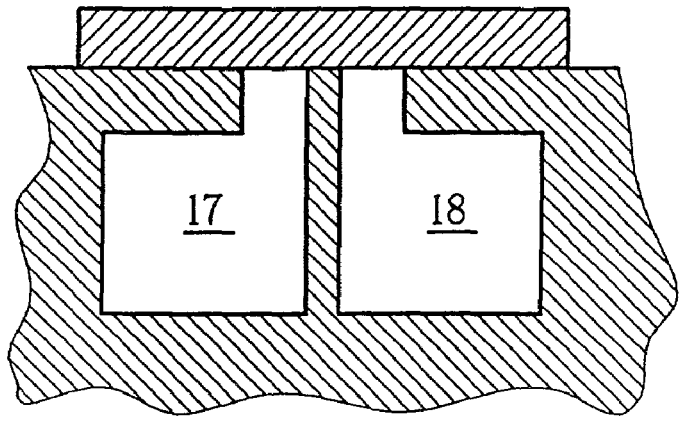
FIG. 7 is a second detail view.
Figure 8:
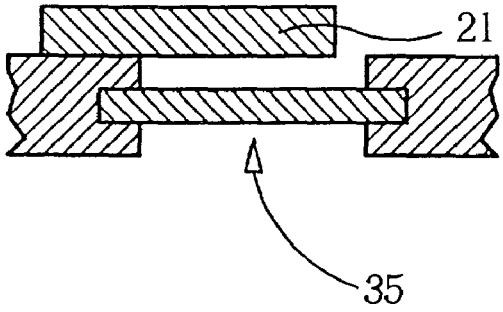
FIG. 8 is a third detail view.

Of course, the use of piezoelectric elements which have an especially large expansion coefficient is preferred. In this way, it is possible to influence individual electroacoustic elements separately. For example, in the area of the capsule or the friction pill channels 16 in the component 19 can be opened or closed individually by means of a piezoelectrically reacting plate 21 via excitation with control voltage, as illustrated in FIG. 6. However, it is also possible to enlarge the size of an acoustically significant volume 17 by connecting it in parallel with a different volume 18, as illustrated in FIG. 7. It is also possible to mechanically move or "cover" entire friction pills arranged, for example, in the sound passage openings (inlets) 35, as illustrated in FIG. 8. Reference numeral 21 refers to a plate made of piezoelectric material which is operated by a control voltage in the manner described above. The plate 21 excited in this way by the control voltage opens or closes the elements provided for the acoustic tuning within the capsule (not illustrated in detail).

A dynamic adjustment of an electroacoustic transducer or capsule which operates according to the electrostatic principle and functions as a microphone, is characterized in that, as shown in FIG. 5, between the main sound source 22 and the microphone a sound receiver 23 is arranged which determines the sound level and whose measured value is employed for a controllable power supply 24 for controlling the voltage for the electrostrictive or magnetostrictive element. As a result of the rapid data processing and the rapid adjustment of the piezoelectric components, the output level of the microphone can thus be adjusted to the actual sound level during recording as a function of the actual sound level.

While specific embodiments of the invention have been shown and described in detail to illustrate the inventive principles, it will be understood that the invention may be embodied otherwise without departing from such principles.

What is claimed is:

1. An electroacoustic microphone, comprising an electrode and a diaphragm connected to a microphone amplifier via electrical contacting, said electrostatic microphone comprising at least one electrostrictive element electrically connected to a second electrical circuit, said second electrical circuit being independent from the electrical contacting of the electrode and diaphragm, and further comprising a controllable power supply for applying a predetermined voltage to the electrostrictive element such that the electrostrictive element changes its dimension and in turn changes the geometry and the acoustic properties of the electrostatic microphone.

2. The electroacoustic microphone according to claim 1, wherein the electrostrictive elements are piezoelectric elements.

3. The electroacoustic microphone according to claim 1, operating electrostatically and comprising a diaphragm and an electrode, wherein the electrode is the electrostrictive element.

4. The electroacoustic microphone according to claim 1, operating electrostatically and comprising an electrode and a diaphragm with an annular spacer securing the diaphragm and the electrode at a spacing from one another, wherein the annular spacer is the electrostrictive element.

5. The electroacoustic microphone according to claim 1, operating electrostatically and functioning as a microphone, further comprising a control loop configured to determine a voltage supplied to the electrostrictive element to compensate manufacturing tolerances and temperature effects having a negative effect on the spacing between the electrode and the diaphragm, wherein the electroacoustic transducer or electroacoustic capsule has a capacitance providing a parameter for the control loop for determining the voltage supplied to the electrostrictive element.

6. The electroacoustic microphone or electroacoustic capsule according to claim 1, operating electrostatically and functioning as a microphone, comprising a sound receiver arranged between a main source of sound and the microphone and determining a sound level, wherein values of the sound level measured by the sound receiver are employed for controlling a voltage supplied to the electrostrictive element.

7. The electroacoustic microphone or electroacoustic capsule according to claim 1, having at least one sound inlet comprising an electroacoustic friction pill arranged in the area of the sound inlet, wherein the friction pill is comprised of two plates of electrostrictive material having edges, wherein on the edges of the plates small openings are provided, wherein the plates are metal-coated on their top and bottom sides and have an electrical contact, wherein the plates are electrically connected in series.

8. The electroacoustic microphone according to claim 7, wherein the electrostrictive elements are piezoelectric elements.

9. The electroacoustic microphone according to claim 1, comprising a sound passage, wherein the electrostrictive elements release or cover the sound passage as a function of the dimensional changes of the electrostrictive elements.

10. The electroacoustic microphone or electroacoustic capsule according to claim 1, comprising a first hollow space and a second hollow space, wherein the electrostrictive elements connect or separate the first and second hollow spaces as a function of the dimensional changes of the electrostrictive elements.

11. The electroacoustic microphone according to claim 1, comprising a component with a channel, wherein the electrostrictive elements release or cover the channel of the component as a function of the dimensional changes of the electrostrictive elements.

* * * * *